US011653727B2

(12) United States Patent
Lin

(10) Patent No.: US 11,653,727 B2
(45) Date of Patent: May 23, 2023

(54) ANTI-DISASSEMBLE WATCH BUCKLE AND A METHOD OF OPERATING THE SAME

(71) Applicant: Climax Technology Co., Ltd., Taipei (TW)

(72) Inventor: Yi-Hsin Lin, Taipei (TW)

(73) Assignee: Climax Technology Co., Ltd., Taipei (TW)

( * ) Notice: Subject to any disclaimer, the term of this patent is extended or adjusted under 35 U.S.C. 154(b) by 198 days.

(21) Appl. No.: 17/223,408

(22) Filed: Apr. 6, 2021

(65) Prior Publication Data

US 2022/0265008 A1 Aug. 25, 2022

(30) Foreign Application Priority Data

Feb. 22, 2021 (TW) ..... 110106087

(51) Int. Cl.
*A44C 5/20* (2006.01)
*A44C 5/14* (2006.01)

(52) U.S. Cl.
CPC ..... *A44C 5/2042* (2013.01); *A44C 5/14* (2013.01); *A44D 2201/16* (2013.01)

(58) Field of Classification Search
CPC ..... A44C 5/2042; A44C 5/14; A44C 5/2071; A44D 2201/16; A44B 11/22; A44B 11/223; A44B 11/24
See application file for complete search history.

(56) References Cited

U.S. PATENT DOCUMENTS 2,525,026 A * 10/1950 Feiner ..... A44B 11/24 24/178
3,049,778 A * 8/1962 Weckesser ..... F16L 3/233 24/180
2018/0092438 A1* 4/2018 Vandenbussche ... A44C 5/2071

FOREIGN PATENT DOCUMENTS

CH 570131 A5 12/1975
CN 106108278 A 11/2016
WO WO2019/096775 A1 5/2019

OTHER PUBLICATIONS

Extended European Search Report dated Oct. 15, 2021 in corresponding European Application No. 21169410.4.

* cited by examiner

*Primary Examiner* — Jack W Lavinder
(74) *Attorney, Agent, or Firm* — Donald E. Stout; Stout, Uxa & Buyan, LLP

(57) ABSTRACT

An anti-disassemble watch buckle includes a bottom housing and a top housing with an in-between space for accommodating a first strap, wherein the anti-disassemble watch buckle has a first end and a second end being opposite to the first end; and a cantilever snap with a back end fastened to the bottom housing at the first end, and a front end hung in the space.

12 Claims, 8 Drawing Sheets

ANTI-DISASSEMBLE WATCH BUCKLE AND A METHOD OF OPERATING THE SAME

CROSS-REFERENCE TO RELATED APPLICATIONS

This application claims priority of Taiwan Patent Application No. 110106087, filed on Feb. 22, 2021, the entire contents of which are hereby incorporated by reference.

BACKGROUND OF THE INVENTION

1. Field of the Invention

The present invention generally relates to a smartwatch, and more particularly to an anti-disassemble watch buckle adaptable to the smartwatch.

2. Description of Related Art

A smartwatch is one of wearable computers that integrate a watch, mobile communication and mobile computing.

The smartwatch usually includes an anti-disassemble buckle to prevent unexpected loose straps. The buckle of some conventional smartwatches ordinarily uses external elements (e.g., screws) to fix the straps, but commonly suffers element lost or mismatch. On the other hand, the buckle of other conventional smartwatches utilizes compression to fix the straps, but being incapable of repeated use, thereby increasing cost and resulting in resource waste.

A need has thus arisen to propose a novel scheme to overcome drawbacks of the buckles of conventional smartwatches.

SUMMARY OF THE INVENTION

In view of the foregoing, it is an object of the embodiment of the present invention to provide an anti-disassemble watch buckle adaptable to a smartwatch with a simplified mechanism and a simple to use manner, being capable of being repeatedly disassembled and assembled, thereby increasing operating life and preventing resource waste.

According to one embodiment, an anti-disassemble watch buckle includes a bottom housing, a top housing and a cantilever snap. A space is disposed between the bottom housing and the top housing for accommodating a first strap, the anti-disassemble watch buckle having a first end and a second end being opposite to the first end. The cantilever snap has a rear end fastened to the bottom housing at the first end, and a front end hung in the space.

DETAILED DESCRIPTION OF THE INVENTION

Figure 1:
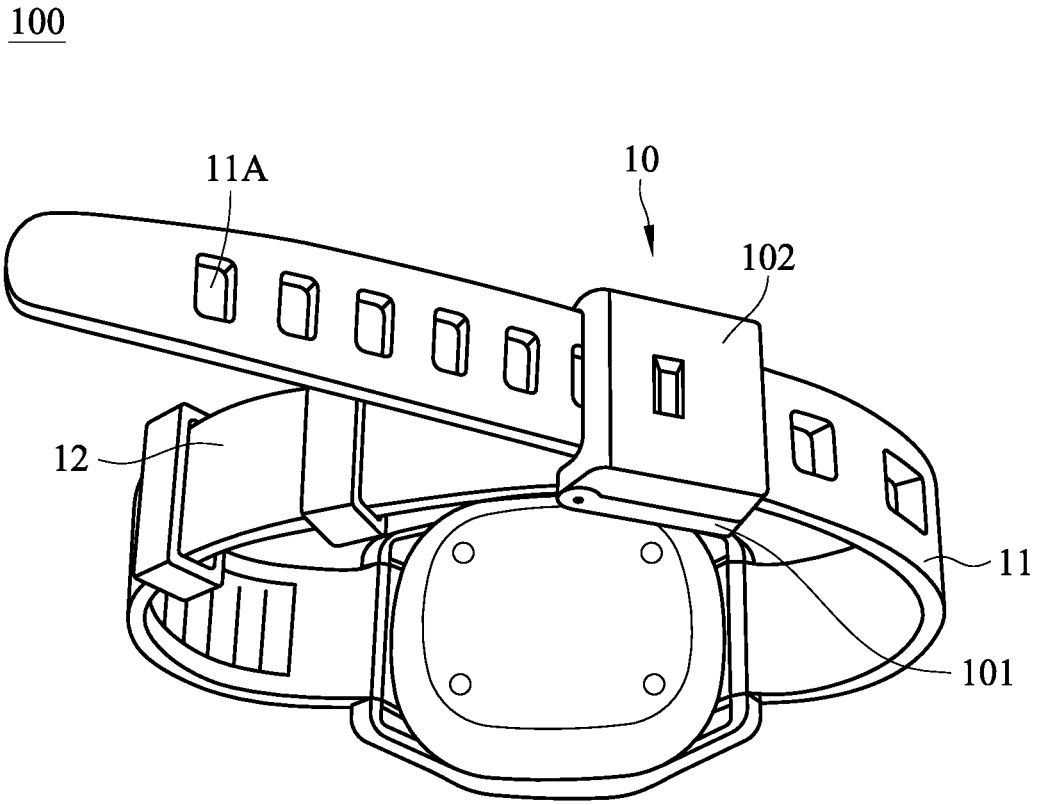
FIG. 1 shows a perspective view illustrating an anti-disassemble watch buckle adaptable to a smartwatch according to one embodiment of the present invention.
Figure 2:
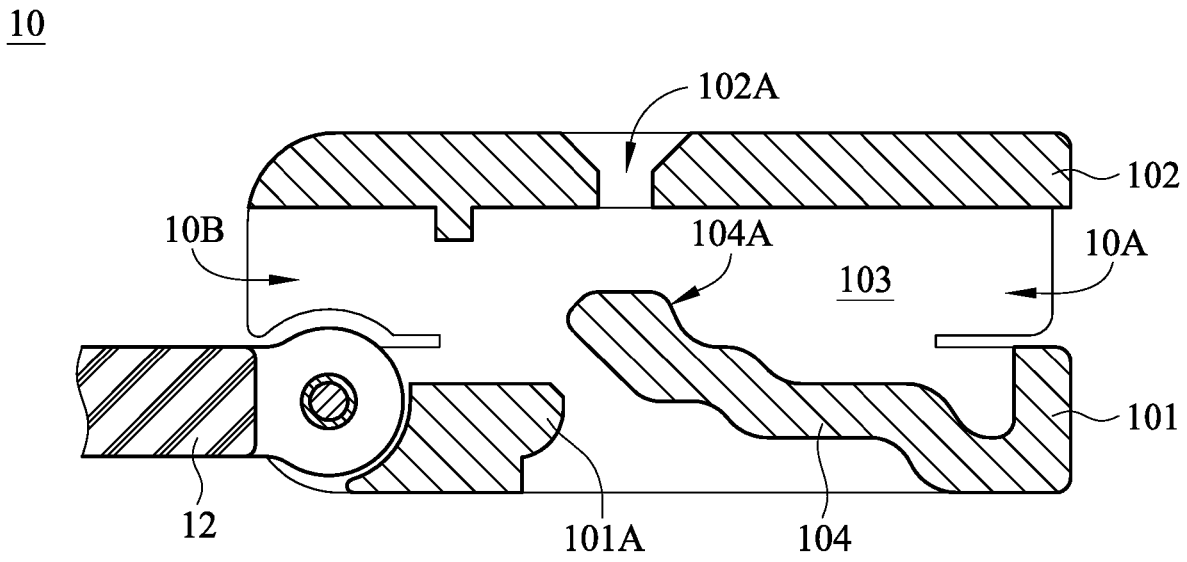
FIG. 2 shows a cross-sectional view illustrating the anti-disassemble watch buckle according to one embodiment of the present invention.

FIG. 1 shows a perspective view illustrating an anti-disassemble watch buckle 10 adaptable to a smartwatch 100 according to one embodiment of the present invention. FIG. 2 shows a cross-sectional view illustrating the anti-disassemble watch buckle (buckle hereinafter) 10 according to one embodiment of the present invention.

In the embodiment, the buckle 10 may include a bottom housing 101 and a top housing 102 with an in-between space 103 for accommodating a first strap 11. The first strap 11 may enter the space 103 via a first end 10A of the buckle 10 and move toward a second end 10B of the buckle 10, where the second end 10B is opposite to the first end 10A. A second strap 12 is fastened to the bottom housing 101 at the second end 10B of the buckle 10, for example, with screw.

According to one aspect of the embodiment, the buckle 10 may include a cantilever snap (or hook) 104 with a rear end fastened to the bottom housing 101 at the first end 10A of the buckle 10, and with a front end hung in the space 103. The cantilever snap 104 of the embodiment may be made of elastic material, for example, plastics. In one embodiment, the cantilever snap 104 has a smooth zigzag shape, and the cantilever snap 104 and the bottom housing 101 are integrally manufactured.

Figure 3:
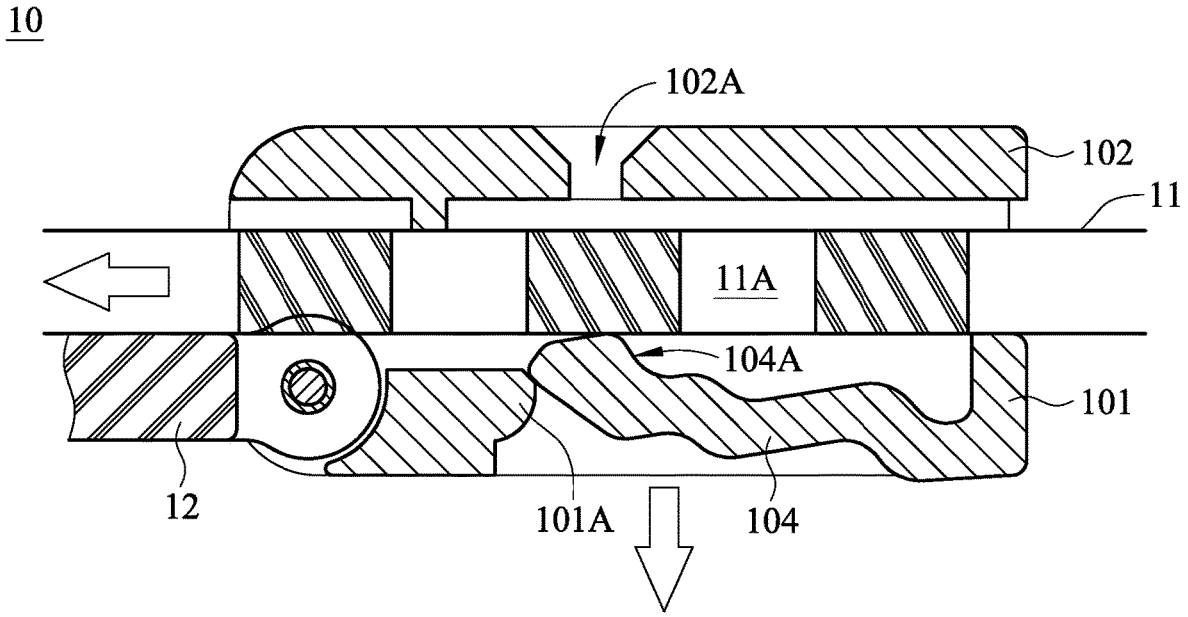
FIG. 3 and FIG. 4 show cross-sectional views illustrating that the first strap enters the buckle in an assemble direction.

FIG. 3 shows a cross-sectional view illustrating that the first strap 11 enters the buckle 10 in an assemble direction (i.e., from the first end 10A to the second end 10B). According to another aspect of the embodiment, the front end of the cantilever snap 104 may have an inclined plane 104A facing the first end 10A of the buckle 10. In one embodiment, an angle between the inclined plane 104A and a bottom surface of the top housing 102 is between 10-80 degrees. When the first strap 11 enters the buckle 10 in the assemble direction, the first strap 11 may compress the cantilever snap 104 by the inclined plane 104A, thereby moving the cantilever snap 104 downward to exit the space 103. Accordingly, the first strap 11 may conveniently enter the space 103 of the buckle 10, thereby facilitating adjusting the first strap 11.

Figure 4:
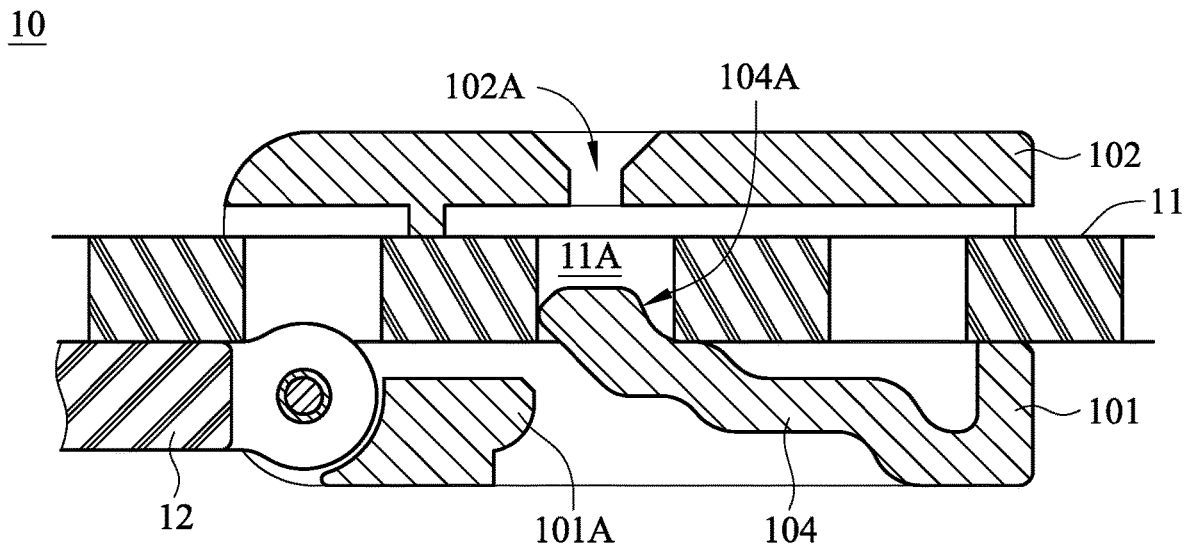

When the front end of the cantilever snap 104 encounters a hole 11A of the first strap 11, the cantilever snap 104 may move upward into the hole 11A by elastic restoring force as shown in FIG. 4. A user may continuously move the first strap 11 to compress the cantilever snap 104 (FIG. 3) or to restore the cantilever snap 104 (FIG. 4) until a proper position has been reached.

Figure 5:
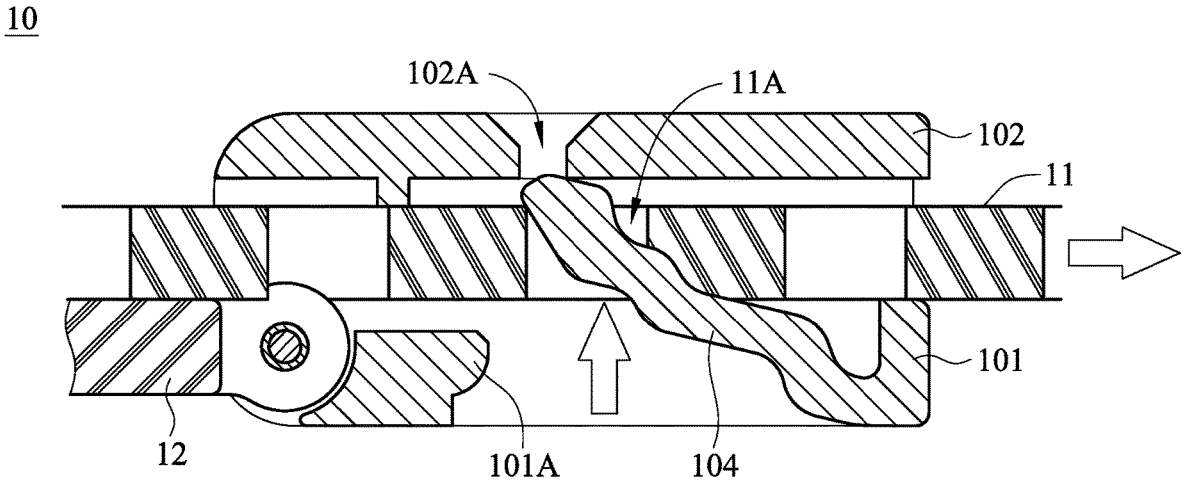
FIG. 5 shows a cross-sectional view illustrating that the first strap exits the buckle in a disassemble direction.

FIG. 5 shows a cross-sectional view illustrating that the first strap 11 exits the buckle 10 in a disassemble direction (i.e., from the second end 10B of the buckle 10 to the first end 10A). In the embodiment, the top housing 102 may have a through hole 102A (e.g., at the center of the top housing 102). As shown in the figure, if the first strap 11 executes disassembling in the disassemble direction, the cantilever snap 104 is compressed and deformed by the first strap 11, and the front end of the cantilever snap 104 encounters the top housing 102 (e.g., the through hole 102A). Accordingly, the buckle 10 of the embodiment can prevent disassembling.

Figure 6:
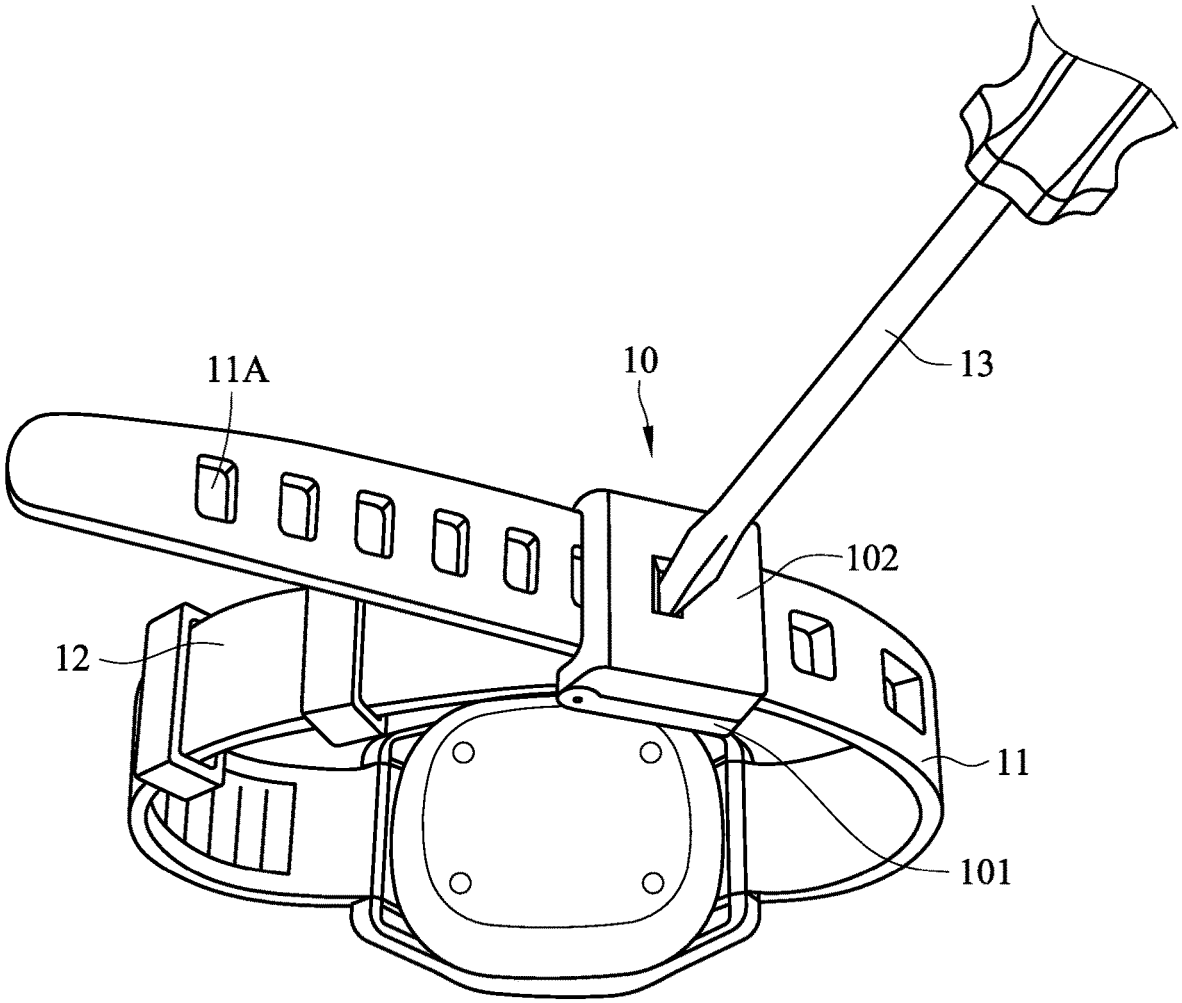
FIG. 6 shows a perspective view illustrating that the buckle of the embodiment executes disassembling.
Figure 7:
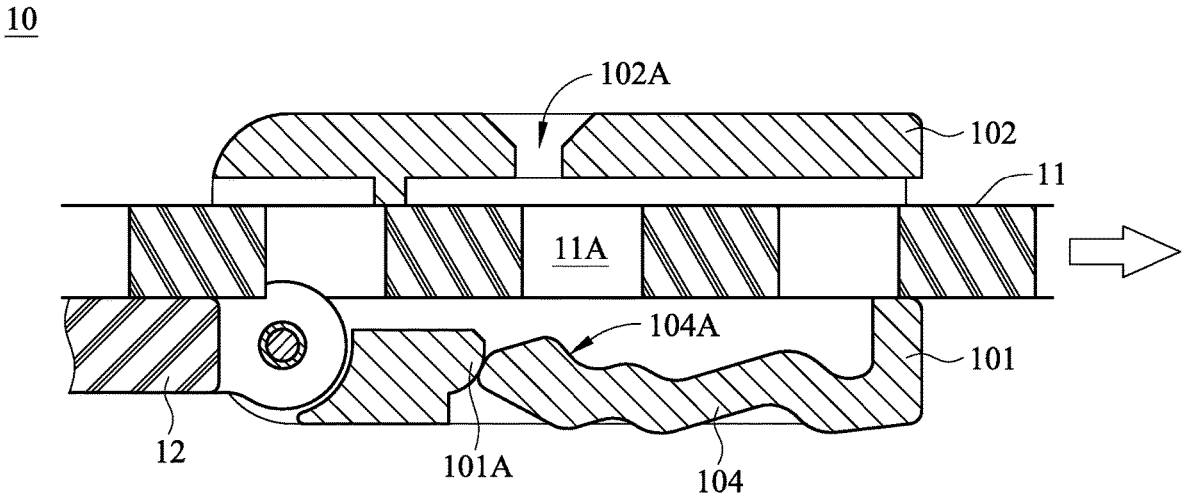
FIG. 7 shows a cross-sectional view illustrating that the buckle of the embodiment executes disassembling.

FIG. 6 shows a perspective view illustrating that the buckle 10 of the embodiment executes disassembling, and FIG. 7 shows a cross-sectional view illustrating that the buckle 10 of the embodiment executes disassembling. In the embodiment, the bottom housing 101 may have a protruding part 101A facing the cantilever snap 104 and the first end 10A of the buckle 10. According to a further aspect of the embodiment, when the buckle 10 executes disassembling, a disassemble tool 13 (e.g., flat-blade screwdriver) may compress the front end of the cantilever snap 104 away the space 103 of the buckle 10 via the through hole 102A of the top housing 102, until the front end of the cantilever snap 104 presses against the protruding part 101A (of the bottom housing 101) as shown in FIG. 7. At this time, the first strap 11 can be disassembled from the buckle 10.

Figure 8:
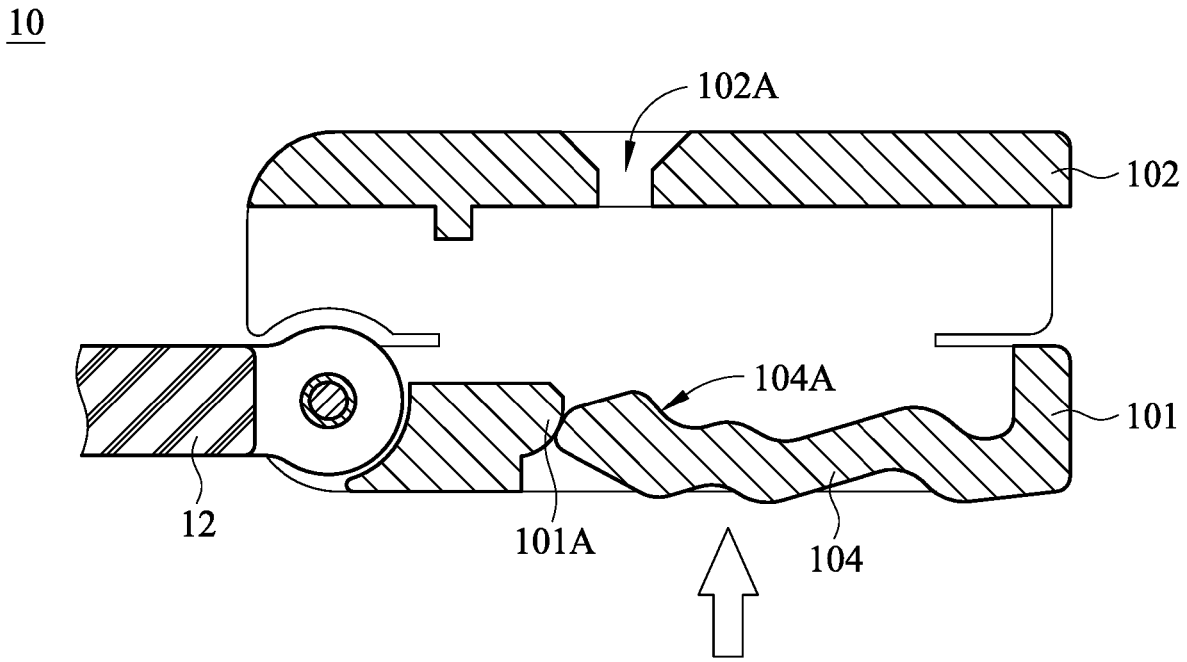
FIG. 8 shows a cross-sectional view illustrating repeatedly using the buckle of the embodiment.

FIG. 8 shows a cross-sectional view illustrating repeatedly using the buckle 10 of the embodiment. As shown in the figure, the cantilever snap 104 is forced upward and separated from the protruding part 101A (of the bottom housing 101), and the cantilever snap 104 then moves upward into the space 103 of the buckle 10 by elastic restoring force. Accordingly, the buckle 10 of the embodiment can be repeatedly used.

Although specific embodiments have been illustrated and described, it will be appreciated by those skilled in the art that various modifications may be made without departing from the scope of the present invention, which is intended to be limited solely by the appended claims.

What is claimed is:

1. A watch buckling system having an anti-disassemble watch buckle and a disassemble tool, the anti-disassemble watch buckle comprising:

a bottom housing and a top housing with an in-between space for accommodating a first strap, the anti-disassemble watch buckle having a first end and a second end being opposite to the first end; and a cantilever snap with a rear end fastened to the bottom housing at the first end, and with a front end hung in the in-between space;

wherein the bottom housing has a protruding part facing the cantilever snap and the first end, and the top housing has a through hole;

wherein the disassemble tool is used to compress the front end of the cantilever snap away from the in-between space via the through hole of the top housing, until the front end of the cantilever snap presses against the protruding part.

2. The watch buckling system of claim 1, wherein a second strap is fastened to the bottom housing at the second end.

3. The watch buckling system of claim 1, wherein the cantilever snap is made of elastic material.

4. The watch buckling system of claim 3, wherein the elastic material comprises plastics.

5. The watch buckling system of claim 1, wherein the cantilever snap has a smooth zigzag shape.

6. The watch buckling system of claim 1, wherein the cantilever snap and the bottom housing are integrally manufactured.

7. The watch buckling system of claim 1, wherein the front end of the cantilever snap has an inclined plane facing the first end.

8. The watch buckling system of claim 7, wherein an angle between the inclined plane and a bottom surface of the top housing is between 10-80 degrees.

9. A method of operating an anti-disassemble watch buckle, comprising:

providing an anti-disassemble watch buckle comprising a bottom housing, a top housing and a cantilever snap, a space being disposed between the bottom housing and the top housing for accommodating a first strap, the anti-disassemble watch buckle having a first end and a second end being opposite to the first end, the cantilever snap having a rear end fastened to the bottom housing at the first end, and a front end hung in the space;

the first strap entering the space via a first end and moving toward the second end;

the first strap compressing the cantilever snap by an inclined plane of the front end of the cantilever snap facing the first end, thereby moving the cantilever snap downward to exit the space;

when the front end of the cantilever snap encounters a hole of the first strap, the cantilever snap moving upward into the hole by elastic restoring force; and a disassemble tool compressing the front end of the cantilever snap away from the space via a through hole of the top housing, until the front end of the cantilever snap presses against a protruding part of the bottom housing, thereby facilitating disassembling the first strap.

10. The method of claim 9, further comprising:

in response to executing disassembling in a disassemble direction by the first strap, the cantilever snap being compressed and deformed by the first strap, and the front end of the cantilever snap encountering the top housing, thereby preventing disassembling.

11. The method of claim 9, further comprising:

forcing the cantilever snap upward and separating the cantilever snap from the protruding part, and the cantilever snap then moving upward into the space by elastic restoring force, thereby facilitating repeated use.

12. The method of claim 9, further comprising:

fastening a second strap to the bottom housing at the second end.

* * * * *